US008955682B2

(12) United States Patent
Lechevalier et al.

(10) Patent No.: US 8,955,682 B2
(45) Date of Patent: Feb. 17, 2015

(54) BOTTLE PACKAGING BOX AND CORRESPONDING CUTOUTS

(75) Inventors: Pascal Lechevalier, Saint Amand (FR); Gerard Mathieu, Cergy (FR)

(73) Assignee: Otor, Paris (FR)

( * ) Notice: Subject to any disclaimer, the term of this patent is extended or adjusted under 35 U.S.C. 154(b) by 380 days.

(21) Appl. No.: 12/594,886

(22) PCT Filed: May 13, 2008

(86) PCT No.: PCT/FR2008/000657

§ 371 (c)(1), (2), (4) Date: Nov. 2, 2009

(87) PCT Pub. No.: WO2008/155482

PCT Pub. Date: Dec. 24, 2008

(65) Prior Publication Data

US 2010/0065618 A1 Mar. 18, 2010

(30) Foreign Application Priority Data

May 11, 2007 (FR) ..... 07 03437

(51) Int. Cl.
*B65D 73/00* (2006.01)
*B65D 71/38* (2006.01)

(52) U.S. Cl.
CPC ..... *B65D 71/38* (2013.01); *B65D 2571/00141* (2013.01); *B65D 2571/00154* (2013.01); *B65D 2571/00283* (2013.01); *B65D 2571/0029* (2013.01); *B65D 2571/00302* (2013.01); *B65D 2571/00567* (2013.01);
(Continued)

(58) Field of Classification Search
USPC ..... 206/485, 751, 752, 763, 764, 765, 168, 206/194, 197, 144, 176, 199, 277, 434, 443, 206/196, 189; 229/162.6, 120.37, 103.2, 229/245, 120.18, 120.17, 89, 189
See application file for complete search history.

(56) References Cited

U.S. PATENT DOCUMENTS 2,334,638 A * 11/1943 Metzger ..... 206/168
2,563,065 A * 8/1951 Price ..... 206/171
(Continued)

FOREIGN PATENT DOCUMENTS

EP 1348638 A 10/2003
FR 2215354 A 8/1974

OTHER PUBLICATIONS

International search report of PCT/FR2008/000657 dated Nov. 17, 2008.

*Primary Examiner* — Jacob K Ackun
*Assistant Examiner* — Jenine Pagan
(74) *Attorney, Agent, or Firm* — Banner & Witcoff, Ltd.

(57) ABSTRACT

The invention relates to a packaging box (1) for substantially oblong products (2), each product having an intermediate part (3) of overall width which is greater than those of its ends (4, 5), comprising a bottom (6, 111, 112) and a lid (7; 109, 110, 112) made of cardboard sheet or corrugated cardboard material. The lid (7) comprises two lateral walls (8, 9; 110, 112) connected to one another by an upper wall (110, 109), the bottom and the upper wall having a width which is smaller than or equal to said overall width and the lateral walls (8, 9) being perforated by apertures (11) spaced apart at regular intervals opposite one another, arranged to allow the respective intermediate parts (3) of said products to be tightly packed.

8 Claims, 11 Drawing Sheets

(52) U.S. Cl.
CPC ..... *B65D 2571/00666* (2013.01); *B65D 2571/0079* (2013.01); *B65D 2571/00796* (2013.01)
USPC ..... 206/485; 206/779

(56) References Cited

U.S. PATENT DOCUMENTS 2,690,839 A * 10/1954 Robinson ..... 206/434
2,877,894 A * 3/1959 Forrer ..... 206/168
2,881,914 A * 4/1959 Woeber et al. ..... 206/434
3,552,082 A * 1/1971 Howard ..... 53/398
3,570,663 A * 3/1971 Cunningham et al. ..... 206/194
4,174,779 A * 11/1979 Slone ..... 206/427
4,262,814 A * 4/1981 Roccaforte ..... 215/232
4,635,795 A * 1/1987 DeFlander et al. ..... 206/526
4,696,402 A * 9/1987 Harmon et al. ..... 229/120.011
5,060,804 A * 10/1991 Beales et al. ..... 229/240
5,080,224 A * 1/1992 Kuhn et al. ..... 206/144
5,437,363 A * 8/1995 Gungner ..... 206/140
5,655,705 A * 8/1997 Bates ..... 229/117.16

* cited by examiner

FIG.1D
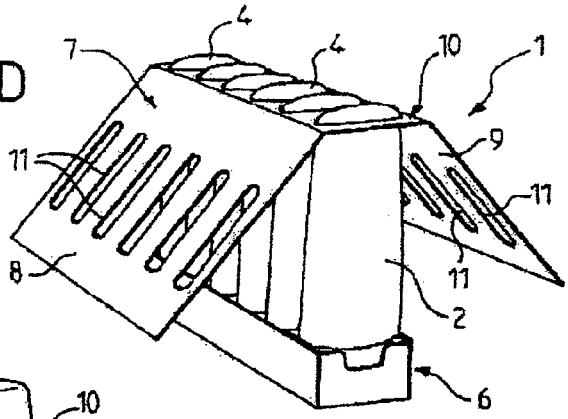
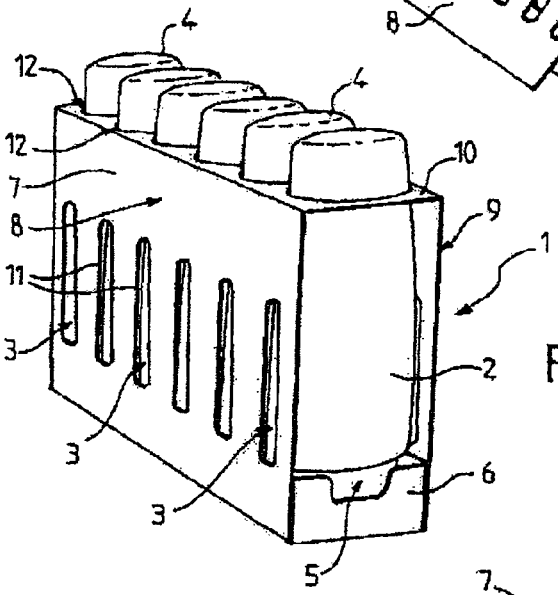
FIG.2
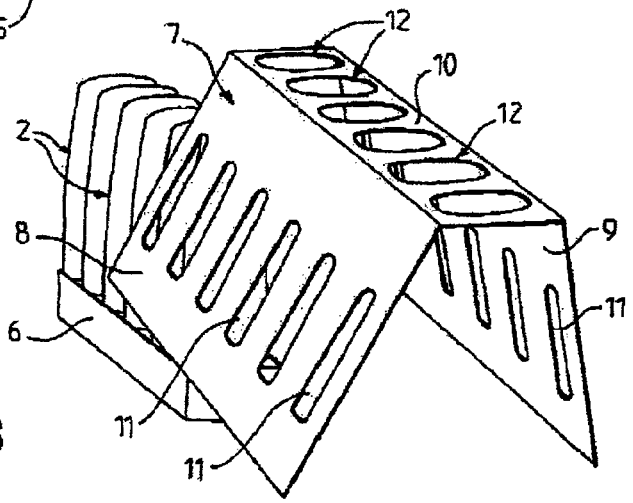
FIG.3

FIG.14A
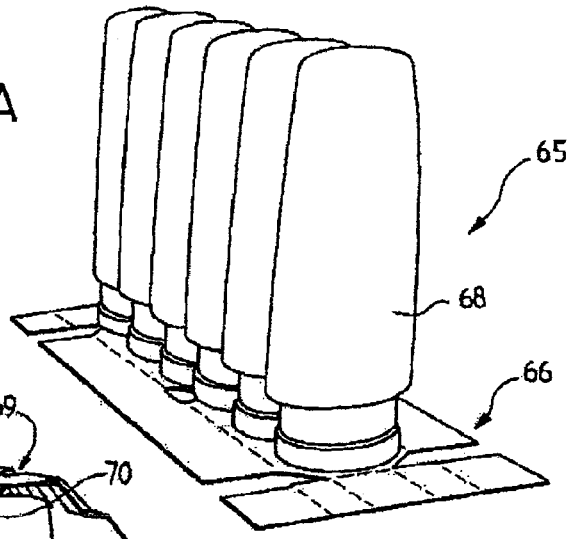
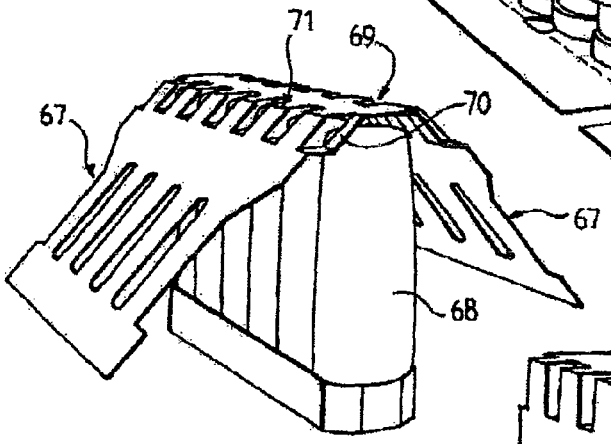
FIG.14B
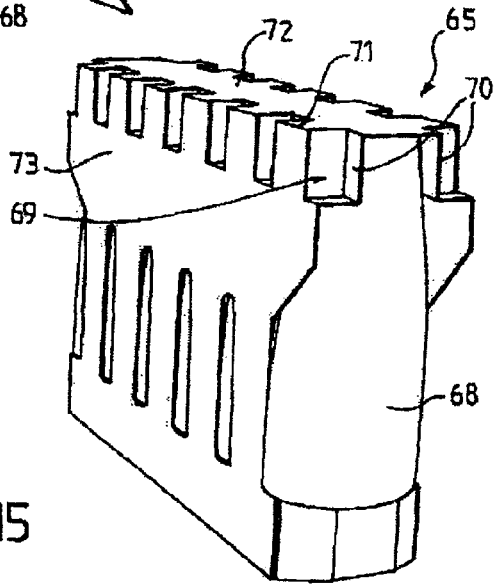
FIG.15

BOTTLE PACKAGING BOX AND CORRESPONDING CUTOUTS

The present invention relates to a packaging box for substantially oblong products such as flasks or glass or plastic bottles, each product having an intermediate part of overall width which is greater than that of its ends, the box comprising a bottom and a lid made of cardboard sheet or corrugated cardboard material.

It also relates to a blank or to a set of blanks making it possible to obtain such a packaging box.

Methods for packaging products (such as shampoo, creams, shower gels, etc.) in flasks or plastic bottles are known, in particular, which use shrink wrap with or without a supporting cardboard sheet, most often in batches of four to ten products.

Such packaging makes it possible to limit the overall width of the package, which actually corresponds substantially to the width of the flasks themselves, the plastic film being of very fine thickness.

This type of packaging has drawbacks, however.

More specifically, the plastic film has to be torn for stacking the products on shelves and for placing them individually onto the shelves. This results in loss of time associated with the repeated handling, to which are added the problems of arranging the products in an aligned manner.

An incorrect orientation and/or risks of falling due to a lack of stability are also observed when a consumer puts a product back on the shelf.

Palletizing shrink-wrapped products is more unstable, as the film has the tendency to stretch over time. It may also have been badly manufactured and/or badly positioned when the package was formed, in view of the occasional random conditions of contraction associated with the temperature of the upstream oven, untimely differences in the unrolling speed of the plastic films when they are continuously positioned, or even the quality itself of the plastic used, often poorly controlled.

Finally, although with such packages the products are practically completely covered in plastic, it is possible for dust to be deposited on the products during long-term storage, in view of the existence of electrostatic phenomena.

In conclusion, although the advantages of plastic film compared to packaging of the cardboard type are, in particular, the low cost of materials and the high packaging speeds, plastic film has disadvantageous drawbacks.

Packages made of cardboard in the form of a tray with a lid, or even in the form of a wrapper, are also known which do not have the drawbacks of the plastic film mentioned above but which are not satisfactory otherwise, as they are too bulky.

More specifically, such packages have excessive thicknesses when palletized side-by-side.

As a result, the total width of a layer of packages is greater than with plastic films.

Thus, this excessive thickness proves to be prohibitive relative to packaging in plastic specifically designed to optimise the merits of storage on pallets.

More specifically up to five centimeters of total difference is observed, which leads to losses of usable volumes, no package being able to overhang an edge of the pallet.

Packaging sheets are also known (FR 2-215-354) permitting the products to be tightly packed, but apart from the fact that said packaging sheets require complex equipment to be fitted tightly onto the products, they do not permit the stability and the rigidity required for good palletization.

The present invention, therefore, aims firstly to remedy the drawbacks mentioned above of the types of packaging of the prior art, whether they are in the form of plastic film or cardboard, whilst presenting the advantages thereof.

Moreover, it is observed that users have increasing demands for packaging of the "retail-ready" type, i.e. easy to stack on the shelves and permitting the promotion of the products, which will be possible with the present invention.

The present invention aims, therefore, to provide a packaging box and a set of blanks responding better than those previously known to the demands of practical experience, in particular in that it permits the grouping of the products on a partially printed support, which may be placed on the shelf and thus ensure the promotion of the products, and the dispensing with shrink wrap which is not ecologically sound, whilst maintaining the logistical advantages thereof, namely not reducing the extent to which the pallet is filled with products due to excessive thicknesses associated with cardboard.

The invention also aims to improve the appearance of the products on said pallets and to produce a package of which the overall width does not exceed that of the products.

This makes it possible for space not to be created between the products on the shelf and, as a result, to optimize the rate of filling the shelves in retail outlets, whilst minimizing the quantity of cardboard used.

To this end, the present invention proposes essentially a packaging box for substantially oblong products, each product having an intermediate part of an overall width which is greater than those of its ends, comprising a bottom and a lid made of cardboard sheet or corrugated cardboard material, characterized in that the lid comprises two lateral walls connected to one another by an upper wall, the bottom and the upper wall having a width which is smaller than or equal to said overall width and the lateral walls being perforated by apertures spaced apart at regular intervals opposite one another, arranged to allow the respective intermediate parts of said products to be tightly packed.

In other words, the invention proposes a packaging box of which the lid completely covers the products and maintains them grouped together in a rigid manner, by being perforated at various points such that the shoulders of the products in the region of their greatest width pass through the perforated zones.

Also and in other words, a package is proposed comprising, on the one hand, products such as disclosed and, on the other hand, a box with perforated walls in which said products are tightly packed as indicated above.

As a result, although the products are grouped together under a lid and on a tray which keeps them stable so that they may be palletized and transported, the external dimensions of the batch over its periphery are identical or less than those of the product on its own, of predetermined size, without the lid and/or the tray. There is, therefore, no excessive thickness compared to grouping together under film and, as a result, no increased cost in logistics.

Advantageously, the bottom is in the form of a base having vertical or substantially vertical walls.

A packaging box is thus also proposed for a plurality of substantially oblong products comprising a bottom and a lid, characterized in that the bottom is in the form of a base with vertical walls over a specific height, to enclose at least partially a first end of the products and having a first specific width, in that the lid comprises two lateral walls connected to one another by an upper wall provided with blocking means spaced apart at regular intervals for the second respective end of each of the products and having a second specific width, equal to or substantially equal to the first specific width, said lateral walls being perforated by apertures spaced apart at regular intervals in a straight line with the corresponding blocking means, to allow said products to be tightly packed at the side.

In advantageous embodiments, moreover, one and/or the other of the following arrangements is used:

- the upper wall is perforated at regular intervals by apertures spaced apart at regular intervals and arranged to allow the respective upper ends of the products to be tightly packed, said apertures thus forming the blocking means of the second ends;
- the bottom and the lid are in one piece;
- the box is formed from a blank comprising a series of four flaps, namely a principal flap forming the bottom provided laterally on its two free edges with folding portions having end tabs, two lateral flaps respectively attached on both sides of the principal flap forming the lateral perforated walls and an end flap attached to one of the lateral flaps forming the upper wall, the other lateral flap and/or said end flap being provided with an adhesive tab;
- the package comprises two elements which may be manually separated from one another, formed from blanks, namely a first element forming the bottom and a second element forming the lid;
- the first element forming the bottom constitutes a display tray formed by a central wall connected to four lateral walls fixed to one another perpendicularly to the central wall by means of end folding portions;
- the second element is formed from a blank comprising a series of three flaps, namely a central flap forming the upper wall and two lateral flaps forming the lateral walls of which the lower peripheral parts are fixed respectively to the two lateral walls opposite the tray;
- the lower peripheral parts comprise a frangible tab permitting the detachment of the tray/lid by tearing;
- the lower peripheral parts of the lateral walls of the lid and the lateral walls of the tray comprise means of fixing one to the other by a snap-in connection;
- the lateral walls of the lid comprise on their periphery adhesive tabs capable of being folded back and bonded under the bottom of the tray;
- the box comprises internal corners with notches capable of ensuring the wedging of the ends of the products.

The invention also proposes a blank or a set of blanks made of cardboard sheet or corrugated cardboard material for forming a packaging box such as described above.

It also proposes a blank or a set of blanks made of cardboard sheet or corrugated cardboard material for forming a packaging box provided with a bottom and a lid for substantially oblong products, each product having an intermediate part of an overall width which is greater than those of its ends, comprising a flap capable of forming the bottom and a series of three flaps capable of forming the lid, characterized in that the series comprises two lateral flaps capable of forming the lateral walls of said lid connected to one another by an upper flap capable of forming the upper wall of said lid, the flap capable of forming the bottom and the upper flap having a width which is smaller than or equal to said overall width and the lateral flaps being perforated by apertures spaced apart at regular intervals and arranged opposite one another and to allow the respective intermediate parts of said products to be tightly packed when the box is formed.

The invention will be better understood by reading the following description of embodiments given hereinafter by way of non-limiting example.

The description refers to the accompanying drawings, in which:

FIGS. 1A to 1D show the steps of producing a packaging box according to a first embodiment of the invention, around the products.

FIG. 2 is a perspective view of the finished package shown in FIG. 1.

FIG. 3 shows the package of FIG. 2 after opening for stacking on a shelf.

Figure 5A:
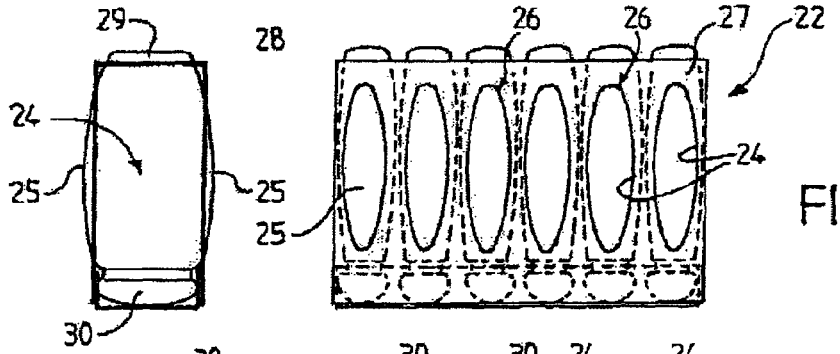
Figure 5B:
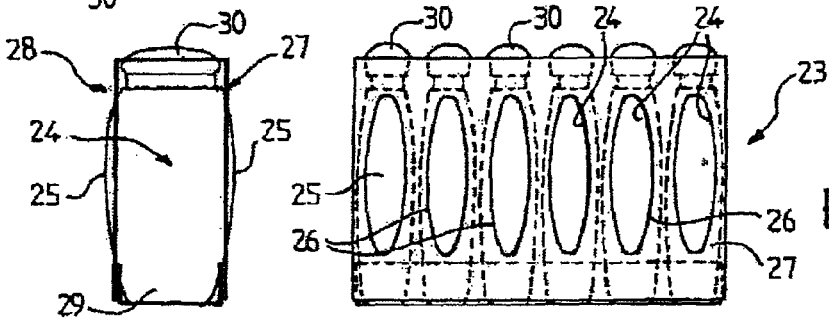

FIGS. 5A and 5B respectively provide profile views and front views of the package of FIG. 2.

Figure 6A:
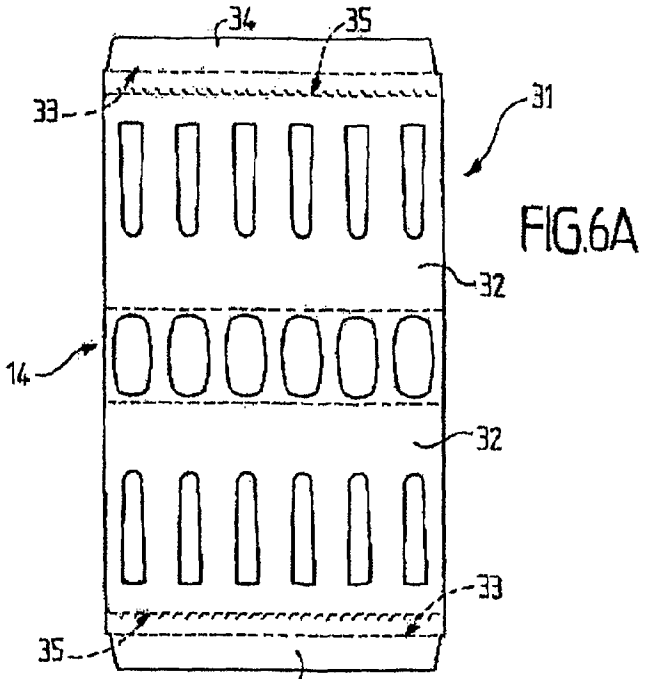
Figure 6B:
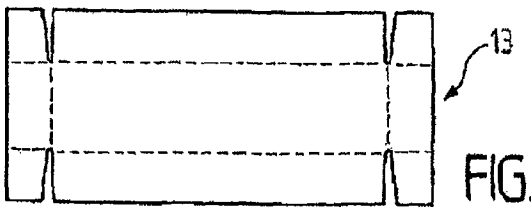

FIGS. 6A, 6B; 7A, 7B; 8A, 8B; 9A and 9B provide a plan view of the sets of blanks according to further embodiments of the invention.

Figure 10:
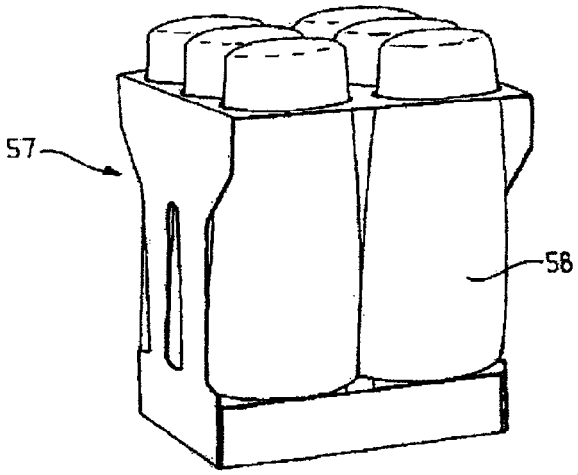
Figure 11A:
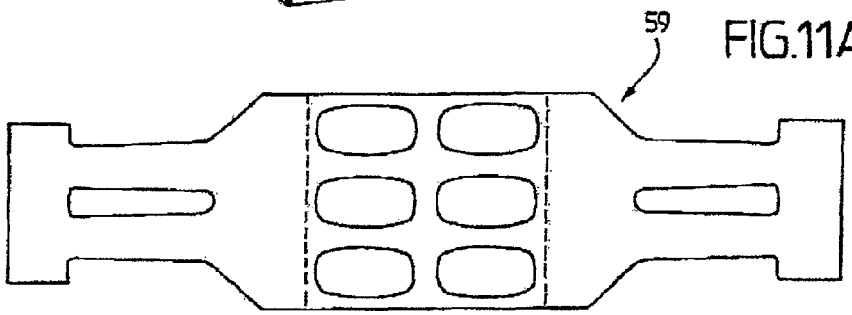
Figure 11B:
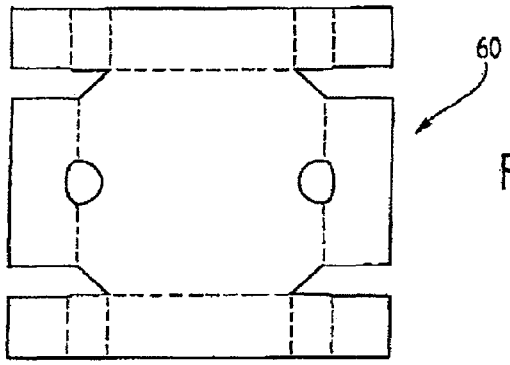

FIG. 10 is a perspective view of a further embodiment of a packaging box according to the invention corresponding to the blanks of FIGS. 11A and 11B.

FIGS. 12A, 12B, 13A and 13B are plan views of further embodiments of sets of blanks according to an embodiment of the invention.

FIGS. 14A and 14B show in perspective a further embodiment of a package according to the invention when positioned around the products.

FIG. 15 is a perspective view of the finished package of FIG. 14 with the blocking system.

Figure 16A:
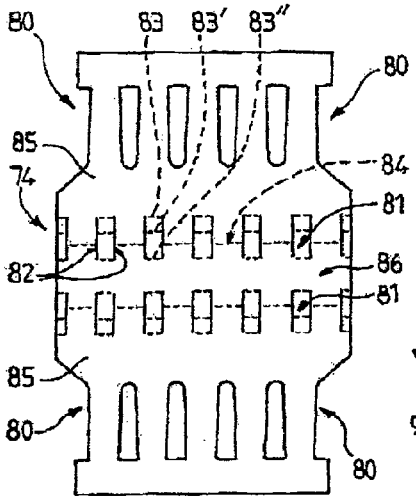
Figure 16B:
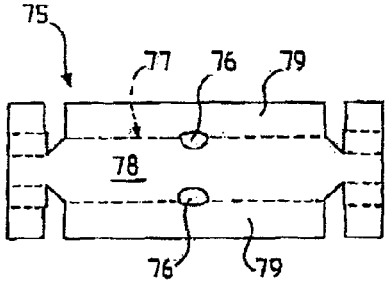

FIGS. 16A and 16B are plan views, the blanks permitting the production of the package of FIG. 15.

Figure 17A:
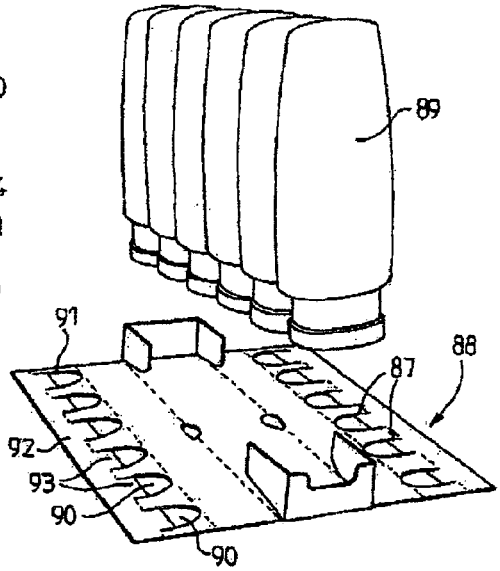
Figure 17B:
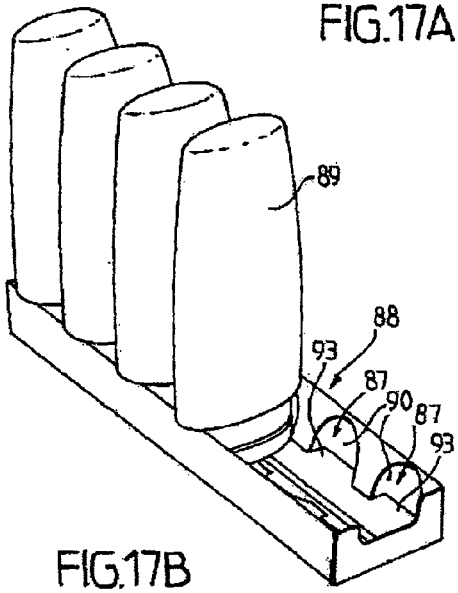

FIGS. 17A and 17B are perspective views of a further embodiment of a tray of a package according to the invention, when being formed with products.

Figure 18A:
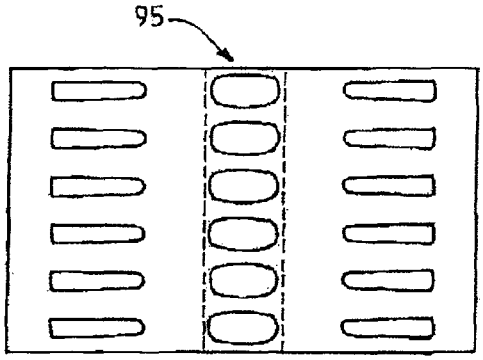
Figure 18B:
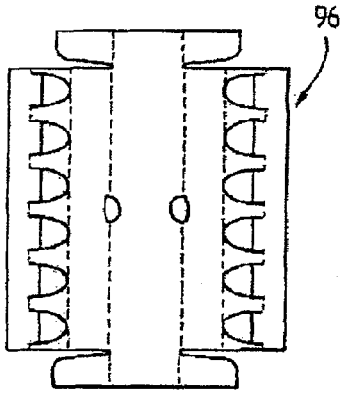

FIGS. 18A and 18B provide a plan view of a further set of blanks according to the invention.

Figure 19A:
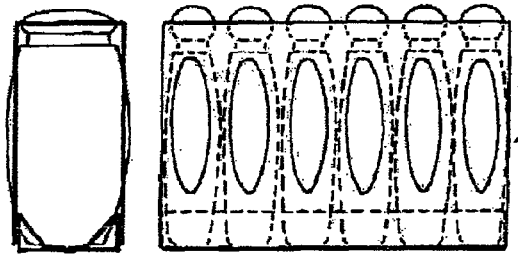
Figure 19B:
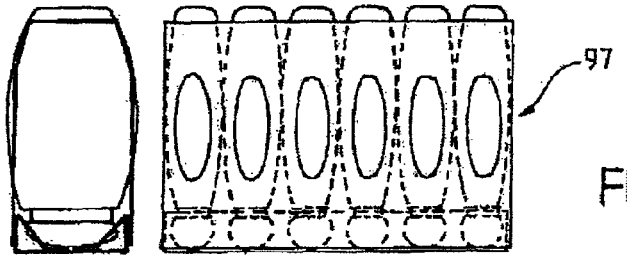

FIGS. 19A and 19B show, in profile, two further embodiments of packages according to the invention with products.

Figure 20:
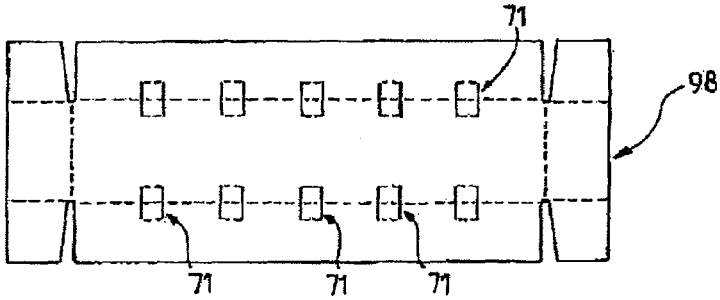

FIG. 20 is a plan view of a blank for a tray with blocking means according to an embodiment of the invention.

Figure 21:
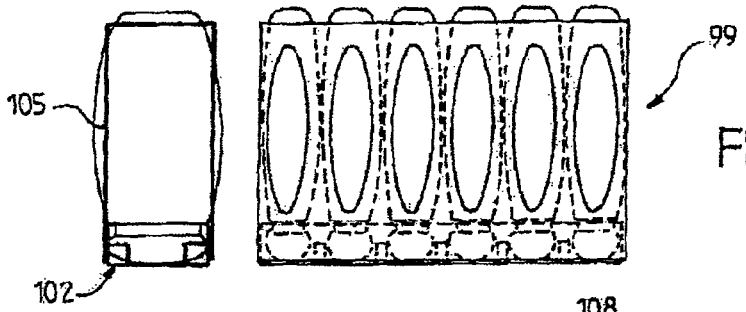

FIG. 21 shows a front view and side view of a further embodiment of the invention with a blocking tray.

Figure 22A:
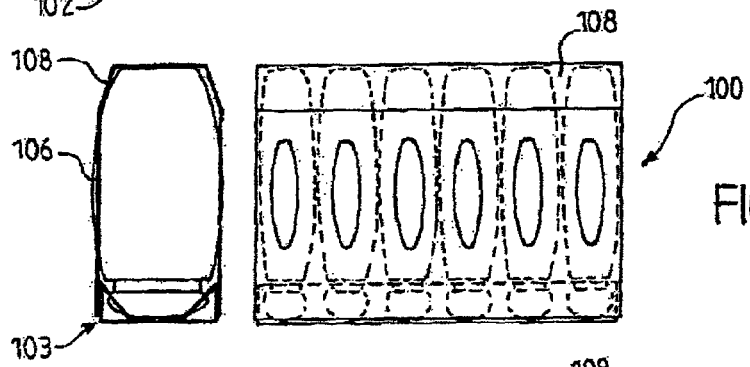
Figure 22B:
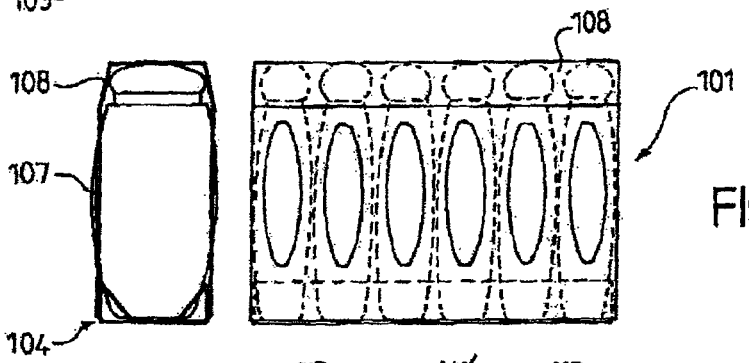

FIGS. 22A and 22B provide a front view and side view of two further embodiments of packages according to the invention.

Figure 23:
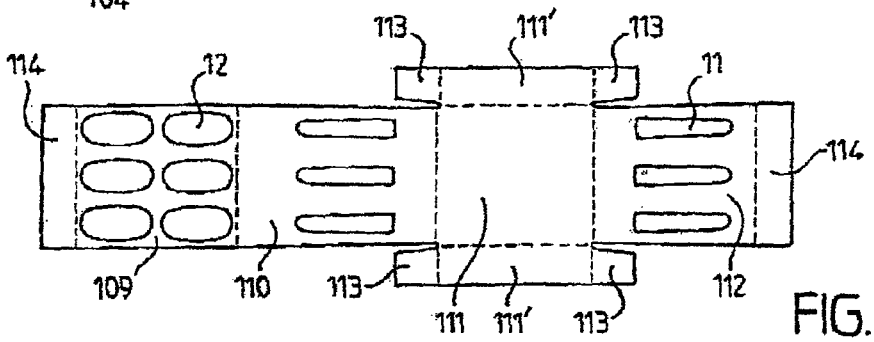

FIG. 23 is a plan view of a blank in the form of a wrapper according to an embodiment of the invention.

FIGS. 1A to 1D and 2 show in perspective a packaging box 1 (see FIG. 2) for substantially oblong products 2, each product 2 having an intermediate part 3 of overall width which is greater than that of its ends 4 and 5, for example constituted by the bottom of the product and its cap 5.

The box 1 comprises a bottom 6 of a first determined width and a lid 7 made of cardboard sheet material, for example of flat cardboard or even of corrugated cardboard of 2 mm or 3 mm thickness.

The lid 7 comprises two identical rectangular lateral walls 8 and 9 connected to one another by an upper rectangular wall 10 of a second specific width, equal to or substantially equal to the first width, for example equal to said first width plus two thicknesses of cardboard, the bottom 6 forming a base of specific height, for example over one fifth of the height of the lid and/or of the box. The specific height is, for example, between one tenth and one third of the total height of the lid and/or of the box.

The first and the second widths are smaller than the overall width of the product in its intermediate part 3.

The lateral walls 8 and 9 are perforated by oval, oblong, rectangular or substantially rectangular apertures 11, spaced apart at regular intervals opposite one another and arranged to allow the respective intermediate parts 3 of the products to be tightly packed.

More specifically, and in this embodiment, these apertures 11 are for example formed by perforated strips of slightly trapezoidal shape of one to two centimeters in width, depending on the intermediate part of the product to be tightly packed.

The upper wall 10 is itself also perforated by oval or circular horizontal apertures 12, spaced apart at regular intervals, located in a straight line with the apertures 11, i.e. with axes centred in the same vertical plane and/or centred symmetrically in identical fashion, (in other words, the centre or the vertical axis of the horizontal apertures is parallel to the vertical axis of symmetry of the apertures 11) arranged to allow the upper ends 4 of the products to be tightly packed, for example formed by the bottom thereof.

Figure 1A:
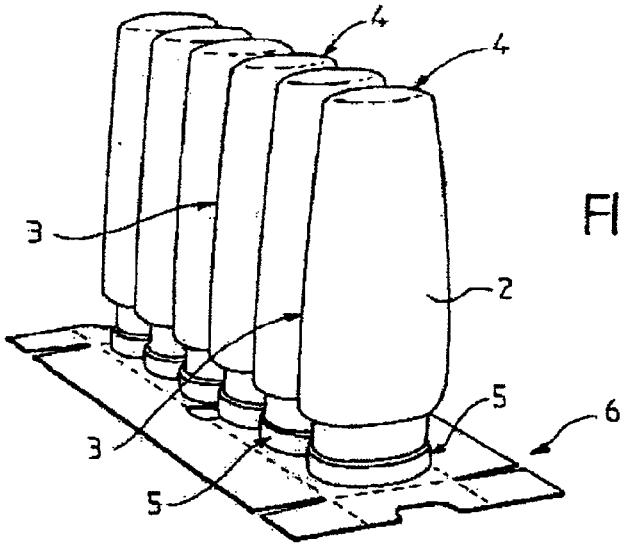
Figure 1C:
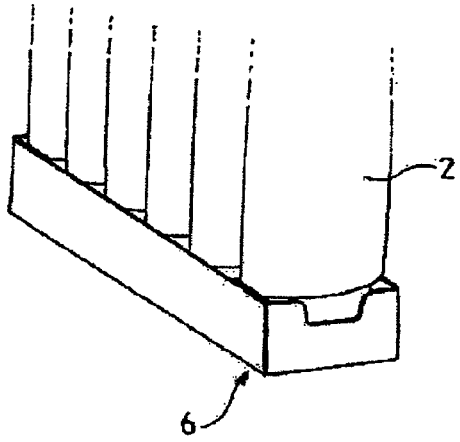
Figure 1B:
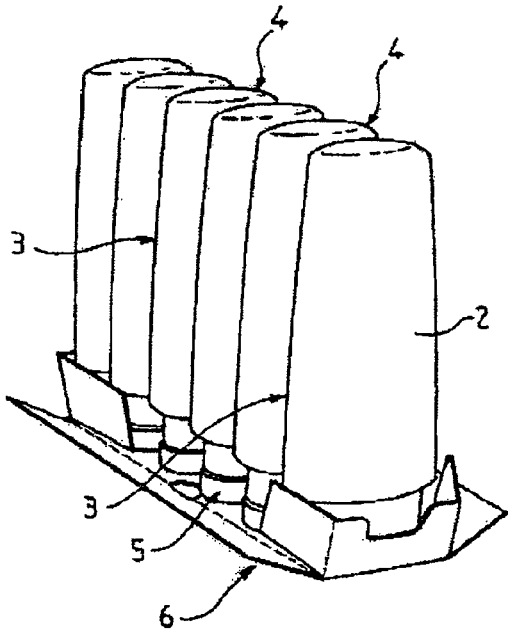
Figure 4A:
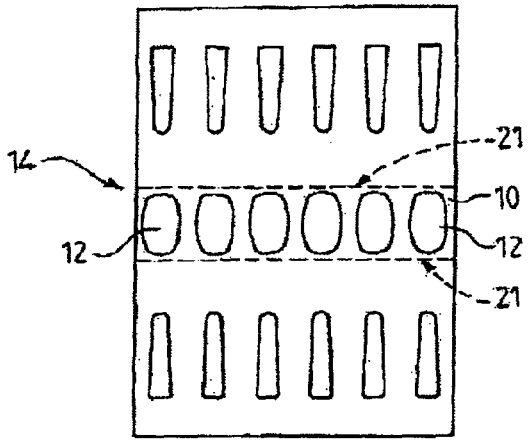
FIGS. 4A and 4B show a plan view of the set of blanks corresponding to the package of FIG. 2.
Figure 4B:
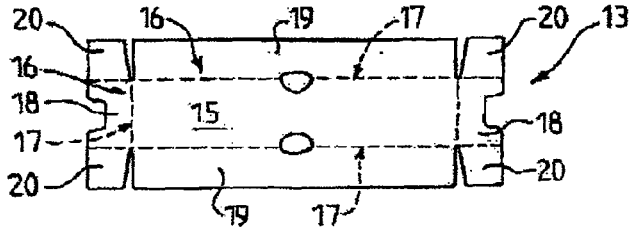

In the embodiment disclosed in FIGS. 1A to 3 the bottom and the lid are formed by two blanks shown in FIGS. 4A and 4B. In this case, there is a first blank 13 capable of forming the bottom in the shape of a tray and a second blank 14 capable of forming the lid.

The first blank 13 arranged to form the display tray 6 comprises a central rectangular flap 15 connected on each of its edges 16 by first fold lines 17 to four lateral flaps opposed in pairs, namely two small transverse flaps 18 and two large longitudinal flaps 19, the small flaps 18 being provided with rectangular or trapezoidal end folding portions 20 located on both sides, connected to the lateral edges of the these transverse flaps 18 by second perpendicular fold lines or in the extension of, or substantially in the extension of, the first fold lines.

The second blank 14 capable of forming the lid 7 itself comprises a series of three flaps, namely a central rectangular flap (upper wall) 10 perforated by the oblong holes 12 intended to receive the bottom and/or the cap 4 or 5 parts of the products 2 and two lateral flaps (lateral walls) 8 and 9, connected to the central flap 10 by parallel fold lines 21, the two lateral flaps 8 and 9 being themselves also perforated by the holes 11 capable of receiving the wider intermediate parts of the products, for example in the form of elongated apertures of substantially rectangular or slightly trapezoidal type.

In FIGS. 5A and 5B two further embodiments of packages 22 and 23 containing products 24 according to the invention are shown, making it possible to show the tight packing of the intermediate parts 25 in the holes 26 of the wider lateral walls 27 of the lid 28 and showing clearly that the overall dimension of the products packaged is identical to that of the non-packaged products.

The products may themselves be arranged top down (FIG. 5A) or top up (FIG. 5B) in the tray, the ends 29 or 30 thus projecting over the lid through orifices created to this end.

Hereinafter the same reference numerals will be used to denote identical elements or similar elements.

FIGS. 6A and 6B show a set 31 of blanks according to an embodiment of the invention demonstrating a first blank 13 for a tray of the type disclosed with reference to FIG. 4B and a second blank 14 for the lid provided on both sides toward the exterior of each of the lateral flaps 32, on the external periphery and connected by a fold line 33, with a substantially rectangular tab 34 capable of being fixed to the bottom of the tray after enclosing the products by means of the lid, for example by bonding. Each of the lateral flaps 32 comprises, for example in the lower part, a frangible tab 35 permitting the detachment of the tray/lid by tearing in the manner known per se.

Figure 7A:
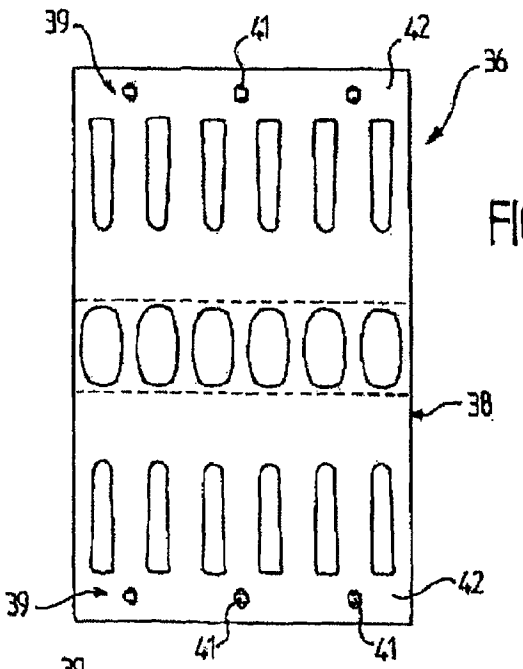
Figure 7B:
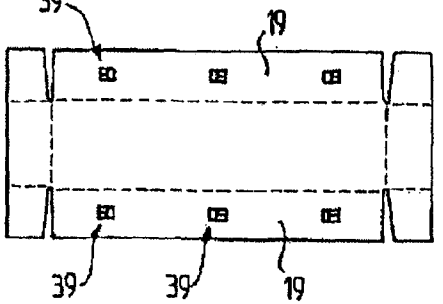

FIGS. 7A and 7B show a further set 36 of two blanks 37 and 38 according to the invention, in this case once again for six aligned products.

In this case, the first blank 37 and the second blank 38 comprise means 39 for fixing one of the blanks to the other by a snap-in connection in the region of their overlap. More specifically, the first blank comprises, regularly spaced apart and longitudinally along the principal lateral flaps 19, one, two, three or more parts 40 formed from small squares which are partially frangible or pre-cut on the middle in a Y-shape, to form a pushed-in corner, arranged to be forcibly snapped with clearance into the pre-set orifices 41 of complementary shape made in the bottom part 42 of the flaps of the lid, to allow a snap-in connection in the manner known per se.

FIGS. 8A and 8B, 9A and 9B provide two further embodiments of a set, respectively 43, 44, of blanks according to the invention for six aligned products, having first blanks 45 of which the central flap 46 is provided with cut corners 47 providing the tray thus formed with a generally octagonal shape, the end folding portions 48 of the transverse flaps 49 on the side of the cut corners, being provided on each side with a small complementary rectangular end folding portion 50, which makes it possible to bond said folding portion again to the external or internal face of the adjacent flap, so as to form the tray of octagonal configuration.

Figure 8A:
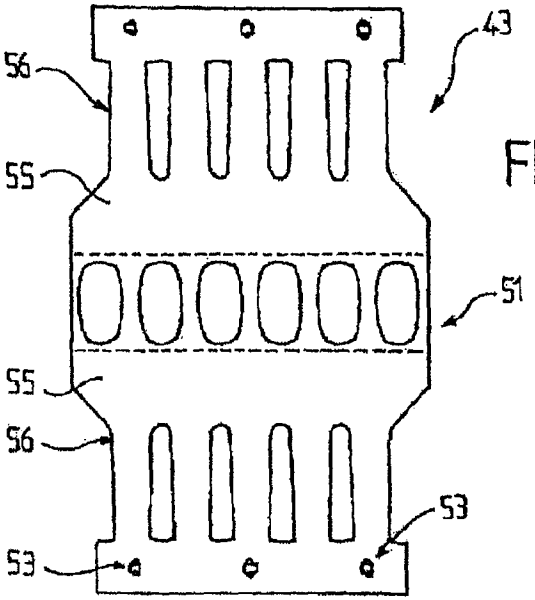
Figure 8B:
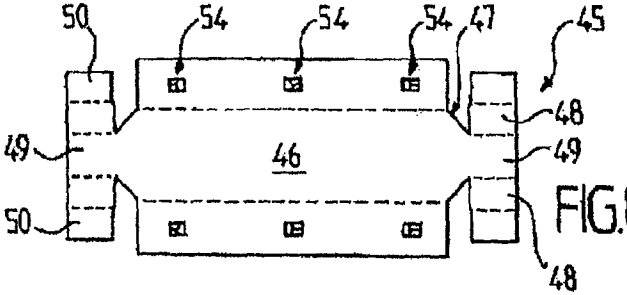

The second blanks 51 comprise, themselves, either tear strips 52 as specified with reference to FIG. 6A (FIG. 9A) with the adhesive tab or snap-in connection means 53, 54 as indicated with reference to FIG. 7A (FIG. 8A).

In the embodiments disclosed here, the second blanks 51 comprise lateral flaps 55 provided with lateral edges having indentations 56, for example forming discontinuous rectilinear lines, to replace the perforated part allowing the end products to be tightly packed.

FIGS. 10, 11A and 11B respectively provide a package 57 for six products 58 in two rows of three, and the corresponding blanks 59, 60 making it possible to form them as in the manner of those described with reference to FIGS. 8 and 9.

FIGS. 12A, 12B, 13A, 13B provide further embodiments of sets of blanks 61, 62 and 63, 64 according to the invention with rectangular end tabs 61', 63' intended to be bonded to the lower face of the tray.

Figure 12A:
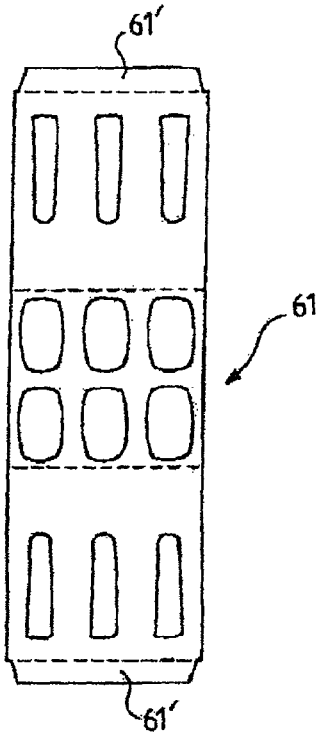
Figure 13A:
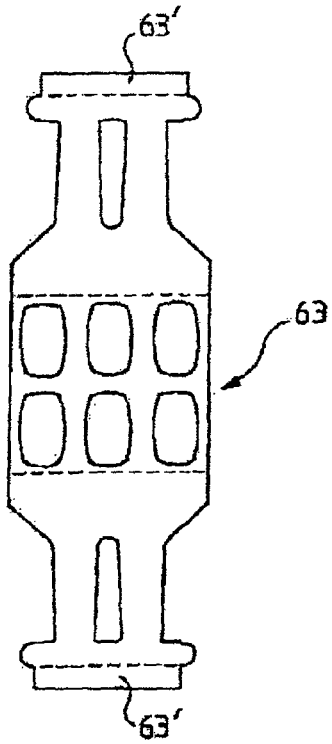
Figure 12B:
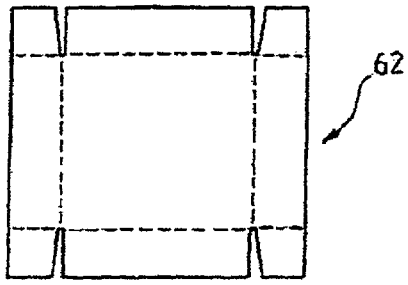
Figure 13B:
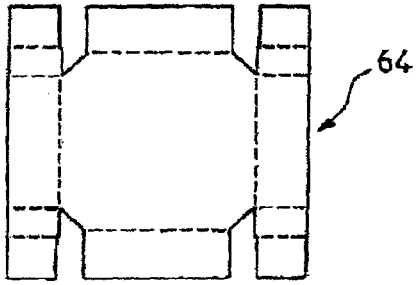

More specifically, FIGS. 12A and 12B correspond to a package for six products (2×3) of the type disclosed with reference to FIG. 6, without the pull tab and FIGS. 13A and 13B correspond to FIGS. 11A and 11B.

Figure 9A:
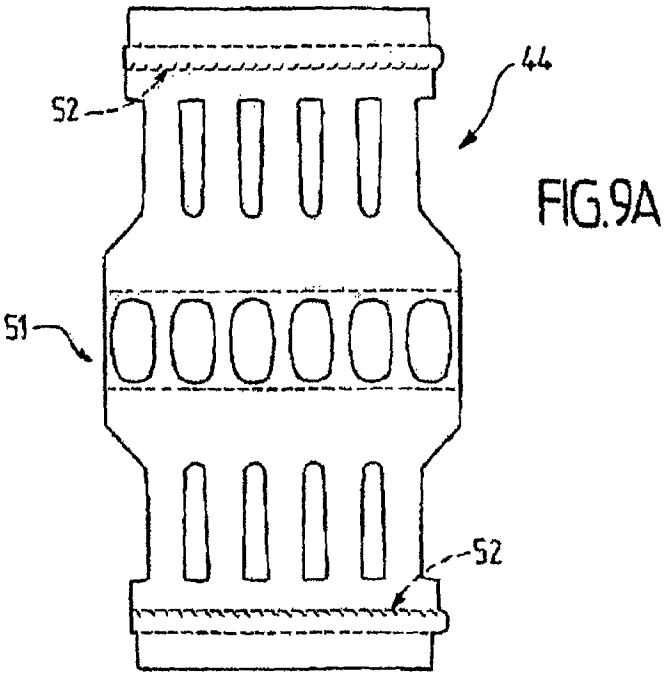
Figure 9B:
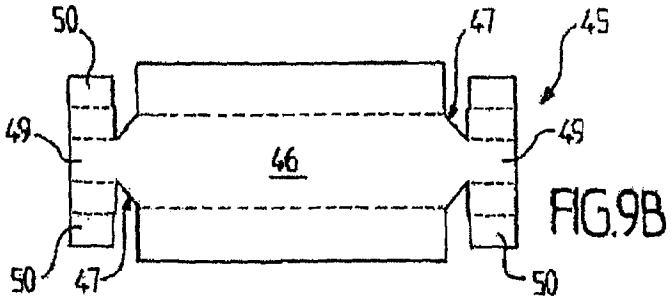

FIG. 14A shows the formation of a package 65 around products of which the lower tray 66 has an octagonal bottom making it possible to follow in an improved manner the contour of the end of the cap of the products, for example, of the same type as that disclosed with reference to FIG. 9B.

The external edge 67 of the flaps of the lid is itself indented, as disclosed with reference to FIG. 8A or 9A, which permits an improved visibility of the products 68 whilst allowing an overall space requirement which is identical thereto.

In the embodiments of the lid of FIGS. 14B and 15, blocking means 69 are provided formed from one pre-cut part 70 straddling the upper edge 71 of the lid formed by the joining fold line between the upper flap 72 and the lateral flap 73 of the lid and which, when it is pushed to the inside of the lid takes on a configuration in the form of a right angle permitting the blockage, as shown in FIG. 15.

FIGS. 16A and 16B provide the blanks 74 and 75 making it possible to form the package of FIGS. 14A to 15.

The blank 75 is, for example, substantially identical to the blank 45 of FIG. 9B with a central orifice 76 which is, for example, substantially oval or circular, straddling the joining fold line 77 between the central flap 78 and the longitudinal lateral flap 79 permitting the detachment of the tray which is fixed at an adhesive point, which is easily detachable by lateral traction, as is the case for the majority of the trays which may be used with the invention.

The blank 74 itself is indented 80 in the form of a broken line and provided with rectangular frangible parts 81 to form the angles 69, and comprises two cut edges 82 and three fold lines 83, 83', 83" parallel to the join line 84, namely two lines in the lateral flap 85 and one line in the central flap 86.

FIGS. 17A and 17B show further embodiments of blocking means 87, in this case in the region of the tray 88 and no longer in the region of the lid of the products 89 in the package.

They are, for example, made up of oblong orifices 90 pre-cut at regular intervals, in the form of inverted arches in a longitudinal folding portion 91, itself connected to an external folding portion 92. One pre-cut portion 93 on two sides and connected to the folding portion 92 without folding is provided to be tightly packed in the oblong orifice to form blocking means in the region of each cap, once the folding portion 91 is folded toward the interior of the tray and the external folding portion 92 is folded perpendicularly and flattened against the bottom of the tray.

FIGS. 18A and 18B provide a plan view of the templates or blanks 94 and 95 to make the tray of FIG. 17B and the packages of FIGS. 19A and 19B.

Said figures provide side views of packages 96 and 97 with the products on the inside, either the cap of the product being upright (FIG. 19A) or facing downward (FIG. 19B), the outer contours (with the caps at the bottom) being thus tightly packed in the oblong orifices.

FIG. 20 provides a further embodiment of the first blank 98 forming a tray with a blocking device 71 of the type disclosed with reference to FIG. 14B for the lid.

FIGS. 21, 22A and 22B provide further embodiments in lateral views of the packages according to the invention.

The packages 99, 100 and 101 respectively comprise, for example, trays 102, 103, 104 respectively of the type of the template 98 (tray 102) or of the template 94 (trays 100 and 101).

The lids respectively 105, 106, 107 are themselves either of the conventional type (105), as disclosed by referring to FIG. 2, or of the encasing type (106, 107) with bevelled corners 108 following the shape of the bottom or the cap at the side.

FIG. 23 is a blank according to a further embodiment of the invention comprising a series of four rectangular flaps 109, 110, 111, 112, attached to one another, when necessary, by parallel fold lines, namely a principal flap 111 forming the bottom provided laterally on its two free folding portion edges 111' with an end tab 113 on both sides, two lateral perforated flaps 110 and 112 according to the invention, respectively attached on both sides of the principal flap 111, forming the lateral perforated walls and an end flap 109 attached to one of the lateral flaps forming the upper perforated wall, said flap 110 comprising on its external edge an adhesive tab 114, as does the flap 112.

Now described with reference to FIGS. 1 to 3 is the formation of a package 1 according to an embodiment of the invention.

From the bottom 6, arranged flat, the products 2 (for example six in number) are placed in rows in a manner known per se, the caps 5 pressed against the central flap.

Then the lateral flaps previously covered with adhesive are folded up (see FIG. 1B) to form the tray 6 which holds the caps 5 tightly.

The lid 7 is then brought over the top, the parts 4 of the products 2 being inserted into the holes 12 opposite the upper flap, then the lateral walls 8 and 9 of the lid, in this case also previously covered with adhesive internally, are folded down, the lower ends being opposite the vertical walls of the tray with which they cooperate by bonding, the intermediate parts 3 of the products thus being inserted into the lateral orifices 11, to obtain the package 1 of FIG. 2, which may then be stored and transported.

When it is desired to stack the products on the shelf, the lower parts of the walls are detached, by detaching them in the known manner per se, by manual lateral traction toward the outside, then the lid is lifted and removed (see FIG. 3) to release the tray and the products which may thus be placed in a group on the shelf.

It goes without saying and as a result of the above, the present invention is not limited to the embodiments described more specifically. The invention encompasses, however, all variants and in particular those where the products are different from those shown and/or those where the lid and the tray are inverted, or even those where the tray is bonded externally to the lower edges of the lid, the clearances being compensated due to the gripping/pressing of the tray on said edges of the lid.

The invention claimed is:

1. A package comprising substantially oblong products, each product having an upper end, an intermediate part and a lower end, said intermediate part having an overall width greater than that of said upper and lower ends and a box comprising a bottom and a lid made of cardboard or corrugated cardboard sheet material, the bottom being formed by a first blank to constitute a tray for presenting the products and having a central wall connected to four side walls glued to one another perpendicular to the central wall through intermediary end flaps, the lid being formed by a second blank comprising a first and a second lateral walls connected to one another by an upper wall, said lateral walls being identical and vertical, said bottom and upper wall having a width less than or equal to said overall width and the lateral walls being perforated with facing uniformly distributed identical apertures engaging the respective intermediate parts of said products, so that the intermediate part in its greatest width passes through the corresponding apertures to be tangential or extend outside of the overall volume of the box, and wherein the first and second blanks are fixed to one another and can be detached from one another by manual lateral traction toward the outside to release the tray and the products.

2. The package according to claim 1, wherein the upper wall is perforated with uniformly distributed apertures arranged to allow the engagement of the respective upper ends of the products.

3. The package according to claim 2, wherein the uniformly distributed apertures are oval or circular, centred in a same vertical plane and arranged to tightly pack the upper ends of the products.

4. The package according to claim 1, wherein the first and second lateral walls having lower peripheral parts in front of two corresponding side walls of the tray, said lower peripheral parts are fixed by gluing respectively to the corresponding facing side of said side walls of the tray.

5. The package according to claim 4, wherein said lower peripheral parts comprise a breakable tongue allowing for detachment by tearing of the tray and the lid fixed together by gluing.

6. The package according to claim 1, wherein the first and second lateral walls having lower peripheral parts in front of two corresponding side walls of the tray, said lower peripheral parts comprise at their periphery gluing tongues folded and glued under the bottom of the tray.

7. The package according to claim 1, wherein the box comprises internal corners with notches capable of ensuring the wedging of at least one end of the products.

8. The package according to claim 7, wherein the tray comprises internal turn-back with cut outs ensuring that the lower ends of the products are wedged.

* * * * *